299-13 SR
1/1/80 XR 4,181,361

United States Patent [19] [11] 4,181,361
Ridley et al. [45] Jan. 1, 1980

[54] GAS COLLECTION SYSTEM FOR OIL SHALE RETORT

[75] Inventors: Richard D. Ridley; Robert S. Burton, III, both of Grand Junction, Colo.

[73] Assignee: Occidental Oil Shale, Inc., Grand Junction, Colo.

[21] Appl. No.: 747,738

[22] Filed: Dec. 6, 1976

Related U.S. Application Data

[63] Continuation of Ser. No. 496,969, Aug. 13, 1974, abandoned.

[51] Int. Cl.[2] ..... E21C 41/10; E21C 43/00
[52] U.S. Cl. ..... 299/2; 166/259; 299/13
[58] Field of Search ..... 299/2, 4, 5, 13; 166/256, 259, 302, 50; 48/DIG. 6

[56] References Cited

U.S. PATENT DOCUMENTS

| | | | |
|---|---|---|---|
| 2,801,089 | 7/1957 | Scott, Jr. | 299/2 |
| 3,338,306 | 8/1967 | Cook | 166/50 |
| 3,661,423 | 5/1972 | Garret | 299/2 |
| 3,865,186 | 2/1975 | Von Hippel | 299/2 |

*Primary Examiner*—William F. Pate, III
*Attorney, Agent, or Firm*—Christie, Parker & Hale

[57] ABSTRACT

An in situ oil shale retort in which a cavity filled with broken particles of oil shale is formed within the subsurface oil shale formation and air is forced down through the cavity to sustain combustion of the top layer of oil shale particles, the products of combustion being withdrawn at the bottom of the cavity. A plurality of exhaust pipes traverse the bottom of the cavity and extend out through the sealed entrance to the retort cavity. The pipes are supported above the floor of the cavity and have holes opening on the bottom side of the pipes through which the product gases are withdrawn from the cavity. Valves in each pipe control the flow so as to balance the flow distribution of air and exhaust gases through the retorting cavity.

15 Claims, 2 Drawing Figures

GAS COLLECTION SYSTEM FOR OIL SHALE RETORT

CROSS REFERENCE TO RELATED APPLICATION

This is a continuation of application Ser. No. 496,969, filed Aug. 13, 1974, now abandoned.

FIELD OF THE INVENTION

This invention relates to in situ retorting of oil shale and more particularly to balancing the retorting action throughout the retort cavity.

BACKGROUND OF THE INVENTION

In situ retorting of oil shale to recover the liquid and gaseous carbonaceous values present in the shale has heretofore been proposed. One such arrangement is described in U.S. Pat. No. 3,661,423 assigned to the same assignee as the present invention. The in situ retorting process described in this patent involves forming a cavity in the oil shale formation in which the cavity is filled with oil shale particles. Air is brought in at the top of the cavity to sustain combustion of the top layer of the oil shale particles. The hot products of combustion pass downwardly through the lower layers of oil shale particles and are withdrawn at the bottom of the cavity. This heats the oil shale particles up sufficiently to drive off the liquid and carbonaceous values from the oil shale particles. The liquid values accumulate at the bottom of the cavity and the carbonaceous values are withdrawn along with the product gases through a pipe terminating adjacent the bottom of the cavity.

While the in situ recovery process described in the patent is effective in the recovery of oil from oil shale, it has been found that the flow of air and product gases down through the retort may not be evenly distributed over the cross-sectional area of the cavity. As a result, the burning rate may not be uniform and the retorting may not proceed as efficiently is some areas as others. As a result, the entire volume of oil shale particles may not be completely retorted, thereby greatly decreasing the overall efficiency of the retorting process.

SUMMARY OF THE INVENTION

The present invention is directed to an improved arrangement for exhausting the product gases from the bottom of the cavity in a controlled manner to provide more equalized distribution of gas flow down through the oil shale particles. This is accomplished, in brief, by providing a plurality of parallel pipes adjacent the bottom of the retort chamber, the pipes being spaced from the floor of the chamber by resting on top of mounds of rock fill. Each pipe is brought out through a side tunnel having a bulkhead which seals off the tunnel from the retorting cavity. The pipes are provided with a series of openings on the bottom side of the pipe through which gases enter the pipes and are withdrawn through the bulkhead. Each of the pipes is provided with a valve for regulating the flow through the respective pipes to achieve balanced flow of product gases down through the retorting volume.

DESCRIPTION OF THE DRAWINGS

For a better understanding of the invention, reference should be made to the accompanying drawings, wherein.

DETAILED DESCRIPTION

Figure 1:
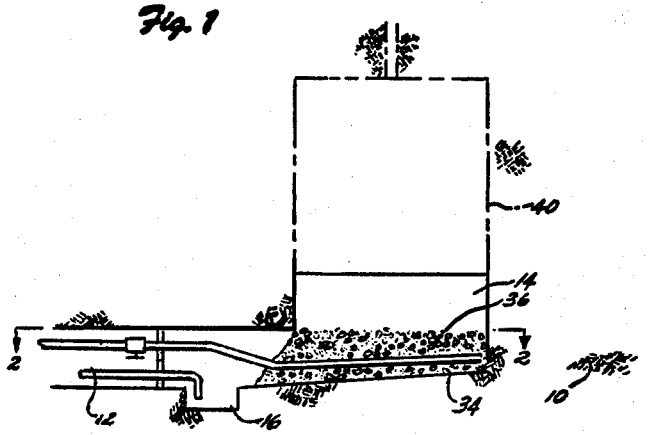
FIG. 1 is a sectional view in elevation of an in situ retort incorporating the features of the present invention.
Figure 2:
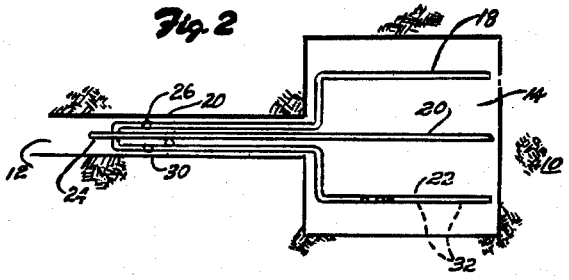
FIG. 2 is a cross-sectional view taken substantially on the line 2—2 of FIG. 1.

Referring to the drawings in detail, numeral 10 indicates generally a subsurface formation of oil bearing shale of the type commonly found in the Rocky Mountain region of the United States. An in situ retort is provided in the oil shale formation by means of a substantially horizontal access tunnel 12 which communicates with the surface of the ground. The inner end of the tunnel 12 is excavated and enlarged to form an upwardly extending chamber 14. The chamber 14 is blasted or otherwise cut out of the oil shale formation, and the shale material excavated in forming the chamber is removed through the tunnel 12. A sump 16 is provided in the floor of the tunnel 12 outside of the chamber 14 and serves as a collection point for the liquids driven off from the oil shale during the retorting process.

After the chamber 14 is formed, pipes for exhausting the gaseous products are run into the lower portion of the chamber 14. In the drawings, three parallel pipe sections 18, 20 and 22 are shown, but the number of pipes may be increased, depending upon the size of the retort chamber. The three parallel pipes are brought out through the tunnel 12 where they are preferably connected to a common outlet-pipe 24 through a manifold and separate control valves 26, 28 and 30, respectively. The three valves can be individually adjusted to modify the gas flow in the respective pipes. The pipe 24 may be connected to a suitable pump or blower in the manner described in copending application Ser. No. 492,823, filed July 29, 1974, now abandoned, and entitled "Method and Apparatus for Retorting Oil Shale at Subatmospheric Pressure" and assigned to the same assignee as the present invention.

The respective pipes 18, 20 and 22, within the chamber 14, are provided with a series of holes, as indicated at 32, distributed along the undersides of the pipes. The pipes are supported off the bottom of the chamber 14 on mounds of rock fill placed under the pipes to the depth of approximately one foot. The lower part of the chamber 14 is then filled with oil shale particles to a depth of four or five feet, completely covering over the pipes 18, 20, and 22 with a protective layer of oil shale, as indicated at 36. By placing the holes 32 on the underside of the pipes, gases are able to enter the pipes through the coarse rock fill 34 on which the pipes are supported while, at the same time, the holes are protected against being clogged by solid particles or liquids during the retorting process.

Once the exhaust pipes are in place in the manner described hereinabove, blasting charges are set in the oil shale formation above the chamber 14. An enlarged cavity is formed in the oil shale formation by setting off the charges, the enlarged cavity forming an upward extension of the chamber 14. This enlarged cavity, indicated at 40, is filled with particles of oil shale formed during the blasting operation.

The pipes 18, 20 and 22 are preferably made of an 8" diameter pipe having a very thick wall, for example, Schedule 80 pipe, to withstand the force of the blasting operation. The pipe is further protected from damage by the overlying layer 36 of oil shale which is put in place before the blasting operation.

Once the blasting operation is completed, vents are opened to atmosphere in the top of the retort cavity to permit air to be drawn into the cavity at the top. The oil shale is ignited and burning proceeds. The hot product gases are drawn down through the cavity and out the exhaust pipes. By adjusting the valves, the flow rate through the respective pipes can be balanced to produce uniform burning.

What is claimed is:

1. A method for forming an in situ oil shale retort in an underground oil shale formation, comprising the steps of:

forming a tunnel ino the oil shale, excavating a chamber in the oil shale at the end of the tunnel, placing a plurality of pipes adjacent the bottom of the chamber, the pipes extending into the tunnel and having openings within the chamber; and blasting oil shale particles from overlying oil shale formation above the chamber to enlarge and fill the chamber with broken oil shale particles.

2. A method of claim 1 further including the step of covering the pipes with a layer of oil shale particles before blasting the overlying formation.

3. A method for forming an in situ oil shale retort comprising the steps of:

forming a cavity in an underground oil shale formation, forming a tunnel extending into the cavity adjacent the bottom of the cavity, providing means for venting air into the top of the cavity, placing a plurality of pipes traversing the bottom of the cavity within a portion of the cavity containing particles of broken oil shale and extending out the tunnel, the pipes being supported above the bottom of the cavity by particles of rock within the cavity, the pipes having a plurality of openings on the underside of the pipe along their lengths within the cavity, blasting oil shale from overlying oil shale formation above the cavity to form particles of oil shale in the cavity, and sealing off the tunnel except for the pipes, the pipes providing a plurality of parallel exhaust passages for gases from the retort cavity.

4. The method of claim 3 further including providing separate valve means in each pipe for controlling gas flow through each of the pipes.

5. A method for forming an in situ oil shale retort comprising the steps of:

forming a cavity within an underground oil shale formation;

forming a tunnel extending into the cavity adjacent the bottom of the cavity;

providing means in the tunnel for sealing the tunnel near the cavity;

placing a plurality of horizontally spaced apart gas exhaust pipes traversing the bottom of the cavity, supported above the bottom of the cavity, extending through the means for sealing the tunnel, and having a plurality of openings in the portion of the pipes traversing the bottom of the cavity within a portion occupied by particles of oil shale for providing parallel exhaust gas flow paths from the in situ oil shale retort;

blasting oil shale particles from formation overlying the cavity for forming broken particles of oil shale substantially filling the cavity; and providing means separate from the gas exhaust pipes for collecting liquids from the bottom of the cavity.

6. A method for forming an in situ oil shale retort as defined in claim 5 further comprising providing separate valve means in each gas exhaust pipe for controlling gas flow through each of the pipes.

7. A method of controlling the cross-sectional distribution of gas flowing from the top to the bottom of broken particles of oil shale in an in situ oil shale retort in a subterranean formation comprising the steps of:

excavating a first portion of the subterranean formation to form a chamber extending across the lower portion of the in situ oil shale retort being formed and leaving a second portion of the subterranean formation above the chamber and within the boundaries of the in situ oil shale retort being formed;

placing a plurality of horizontally spaced apart gas exhaust pipes extending across the bottom portion of the chamber, each of said exhaust pipes having a plurality of openings along its length within the portion of the retort being formed which is to contain broken particles of oil shale;

blasting at least a part of the second portion into the chamber to form broken particles of oil shale in the in situ oil shale retort being formed;

introducing gas at the top of the broken particles of oil shale in the retort; and selectively withdrawing gas from the retort through the plurality of horizontally spaced apart gas exhaust pipes extending across the bottom portion of the in situ retort for regulating gas flow through the gas exhaust pipes to balance the flow of gas from the top to the bottom of the broken particles of oil shale in the in situ oil shale retort.

8. A method as recited in claim 7 wherein the gas is withdrawn through holes along the lower side of said exhaust pipes.

9. A method as recited in claim 7 further comprising the step of separately regulating gas flowing through each of said exhaust pipes.

10. A method as recited in claim 7 further comprising the steps of:

placing broken formation particles in the chamber;

placing the pipes on such broken formation particles; and placing broken formation particles over the pipes before blasting.

11. An in situ oil shale retort comprising:

a cavity within an underground oil shale formation;

broken particles of oil shale in the cavity;

means for venting air into the top of the cavity;

a plurality of gas exhaust pipes extending horizontally across the bottom of the cavity and supported aove the bottom of the cavity with openings along the underside of the respective pipes for exhausting gas from selected horizontally spaced apart locations distributed across the bottom of the cavity for providing a plurality of parallel exhaust gas flow paths from the in situ oil shale retort, whereby downward flow distribution of gas through the broken particles of oil shale in the cavity can be balanced; and means separate from the gas exhaust pipes for collecting liquids from the bottom of the cavity.

12. The apparatus of claim 11 including separate valve means in each pipe for controlling gas flow through each of the pipes.

13. A method for recovering liquid and gaseous products from an in situ oil shale retort formed in a subterranean oil shale formation, comprising the steps of:

excavating a cavity in the formation at a lower portion of the in situ oil shale retort being formed;

placing means for exhausting gas at selected horizontally spaced apart locations distributed across a bottom portion of the cavity;

blasting oil shale from overlying oil shale formation above the cavity to form broken particles of oil shale in the cavity;

introducing gas at the top of the broken particles in the cavity for retorting oil shale and producing liquid and gaseous products;

withdrawing exhaust gas including gaseous products through the means for exhausting gas from selected locations distributed across the bottom portion of the cavity;

regulating gas flow through respective means for exhausting gas for balancing flow of gas downwardly through the broken particles of oil shale in the cavity; and withdrawing liquid products from the bottom of the cavity separate from the means for exhausting gas.

14. A method as recited in claim 13 wherein the means for exhausting gas comprises a plurality of pipes extending across a bottom portion of the cavity and spaced above the bottom thereof, and exhaust gas is withdrawn through openings along the underside of the respective pipes.

15. A method as recited in claim 14 in which the gas flow is balanced by separately regulating the gas flowing through each of the exhaust gas pipes.

* * * * *